United States Patent [19]

Pol

[11] 4,137,962

[45] Feb. 6, 1979

[54] APPARATUS FOR MARKING A MOLD SURFACE

[75] Inventor: Kenneth J. Pol, Saginaw, Mich.

[73] Assignee: General Motors Corporation, Detroit, Mich.

[21] Appl. No.: 812,185

[22] Filed: Jul. 1, 1977

[51] Int. Cl.[2] ..... B22C 7/00; B41B 11/52; B44B 5/00

[52] U.S. Cl. ..... 164/236; 101/18; 101/29; 164/249; 164/412; 249/103; 425/169

[58] Field of Search ..... 164/4, 150, 249, 412, 164/235, 236; 249/103, 104, 140, 53 R; 101/13–15, 18, 21, 27, 28, 29, 31, 32, 4, 9; 425/523, 169

[56] References Cited

U.S. PATENT DOCUMENTS

| | | | |
|---|---|---|---|
| 918,342 | 4/1909 | Lose | 164/150 |
| 1,042,210 | 10/1912 | Ferris | 101/29 X |
| 1,652,274 | 12/1927 | Glass | 101/21 |
| 1,844,987 | 2/1932 | Slick | 249/103 |
| 2,330,274 | 9/1943 | Fiske | 164/150 |
| 2,818,014 | 12/1957 | Jacquart | 101/29 X |
| 3,112,688 | 12/1963 | Pannier | 101/18 X |
| 3,269,510 | 8/1966 | Peters | 101/18 X |

*Primary Examiner*—Richard B. Lazarus
*Assistant Examiner*—Gus T. Hampilos
*Attorney, Agent, or Firm*—George A. Grove

[57] ABSTRACT

A casting-marking apparatus is adapted for incorporation in a permanent foundry pattern of the type used to produce sand molds for metal casting. The apparatus carries a marking that is impressed in the sand old and subsequently reproduced on a casting. The apparatus is designed and constructed so that the marking that it carries can be altered from a station remote from the pattern. In the apparatus, the alterable marking is carried by a marking body that is rotated by an air actuated piston.

5 Claims, 6 Drawing Figures

APPARATUS FOR MARKING A MOLD SURFACE

This invention relates to a marking apparatus to be incorporated in a permanent foundry pattern of the type employed to produce sand molds for casting metal. More particularly, the apparatus of the present invention carries an arrangement of markers to shape a portion of each sand mold so that a permanent marking is formed on each casting. In addition the apparatus can be selectively operated from a station remote from the mold-forming surface of the pattern so as to alter the arrangement of the markers in the pattern and thereby change the marking from one casting to the next.

It is the practice in the metal casting industry to mark or label each casting to identify it for quality control purposes and to aid in obtaining an accurate production count. The identification marks generally contain such information as the hour of the day or the shift during which the casting was made. Obviously, this requires the mark to be changed periodically in order to be accurate. Although other information may also be included, the present invention concerns itself with that portion of the mark which requires periodic updating.

A convenient method of displaying recurrent information is by a series of reference marks located about the circumference of a circle and an indicator mark located within the circle and pointing to a desired reference mark. An age old example of this technique is the face of a clock. When a foundry desires to indicate the hour during which a casting was made, it conveniently displays this information on the surface of the casting as a series of reference marks located in equal intervals about the circumference of a circle and serving as the hour marks. A pointer mark located within the circle acts as an hour hand. Thus, the hour hand mark would point to the two-hour mark for castings made between 2 and 3 o'clock. At 3 o'clock the position of the hour hand mark would be changed. In a similar fashion other information such as the day of the week or the shift during which the casting was produced might be displayed.

A preferred method for producing an indelible mark upon the surface of a casting is to incorporate a marker or series of markers in a pattern as part of its mold-forming surface. As the pattern is employed to form the green sand or other suitable material into the mold, the image of the markers is impressed into the mold surface. The mark is then cast as part of the surface of the metal.

A major problem is in changing or updating the mark. Heretofore, the operator had to enter the molding machine in order to reach the pattern surface and manually change the marker. This procedure was not only time consuming, but required elaborate safety precautions to protect the operator while inside the machine. However, development of a mechanical device that would allow the operator to change the mark from outside the molding machine has been hampered because of the durable construction necessary to withstand the tremendous jolts and pressure of the mold-forming operations.

It is an object of the present invention to provide a marking apparatus, bearing at least one movable indicator marker, to be incorporated in a foundry pattern to permanently mark castings made in sand molds formed by that pattern and to be actuated from a point remote from the pattern to alter the position of the marker and thereby change the marking produced on subsequent castings.

It is a further object of the present invention to provide a mechanism actuated by intermittent fluid pressure for changing the position of a marker located on a mold-forming surface of a foundry pattern, the mechanism being small enough to be easily incorporated in the foundry pattern, but durably constructed to withstand the mold-forming operations.

These and other objects of the present invention will appear more clearly from a reading of the following description.

SUMMARY OF THE INVENTION

In accordance with a preferred embodiment, an apparatus is provided that is incorporated in a permanent foundry pattern of the type employed to form a plurality of foundry molds for making metal castings. The apparatus has a marking surface that is adapted to constitute part of the mold-forming surface of the pattern-apparatus assembly. The marking surface usually carries a series of markers arranged in a predetermined manner to convey certain information. The markers generally protrude from the marking surface so that when the mold is formed about the pattern-apparatus assembly, the marker arrangement is impressed in the mold surface. The arrangement is then duplicated on a casting produced with that mold. Thus, the desired information is displayed on the casting surface as a series of marks arranged in the same manner as the markers.

As one example, a marker arrangement on the apparatus marking surface might mark each casting to show the hour during which it was made. This information might be conveniently conveyed by a series of stationary reference markers located about the circumference of a circle, similar to hour marks on a clock face. An indicator marker located within the circle of hour markers acts as a clock hour hand to point to or designate an appropriate reference marker and thus indicate the desired hour. After the hour has passed, the next hour is indicated by varying the marker arrangement. This is accomplished by changing the position or orientation of the indicator marker to designate a different hour marker. The practice of this invention is not limited to making hour marks as the markers might be easily arranged to convey a wide variety of information such as the shift or weekday during which the casting was made. The apparatus is most useful to mark castings with information that periodically changes since an essential feature of this invention is that the apparatus carries a movable marker whose position can be selectively changed to alter the marker arrangement and cause it to convey different information.

In its preferred embodiment, the apparatus comprises a metallic housing defining a cylindrical hollow. One end of the housing constitutes part of the marking surface of the apparatus and may carry stationary reference markers. When incorporated in a pattern, the second end of the housing is embedded in the pattern and lies remote from the mold-forming surface. The housing second end is adapted to admit pressurized fluid into the housing hollow.

Within the hollow adjacent the housing marking end is slidably mounted a generally cylindrical indicator marking body. The marking body has a cylindrical axis which coincides with the cylindrical axis of the hollow and about which it is able to rotate. One end of the apparatus constitutes part of the apparatus marking surface and carries the indicator marker. The marking end is designed such that rotating the marking body changes the position of the indicator marker.

The marking body has a normal marking position in which its marking end lies adjacent to and coplanar with the housing marking end. When in its marking position, the apparatus may be employed in conjunction with a pattern to form a mold and thereby mark the casting. However, when the position of the marker is to be changed, the marking body is advanced along its axis to a position wherein its marking end protrudes above the plane of the housing marking end. At the same time, the marking body is rotated to place the indicator marker in its new desired position. Later the body is returned axially to its marking position. One advantage of having the marking body move axially during marking-changing operations is that the operator outside the molding machine can observe the operations as they take place.

Located within the housing hollow adjacent the indicator marking body is a cylindrical piston. The piston is employed to rotate the marking body to thus change the position of the indicator marker. The cylindrical axis of the piston coincides with the hollow axis and it is slidably mounted so that it is capable of rotating about and reciprocating along its axis. A pulse of compressed air admitted by an operator through the housing second end forces the piston to move axially from its rest position causing the marking body to simultaneously advance from its normal marking position to its marking-changing position. The advancing marking body and piston compress a coil spring that acts as a counterforce to the compressed air.

The advancing piston is also rotated through a predetermined angle by suitable gear means. The angle of rotation is controlled by limiting the distance of the piston motion and by the pitch angle of the gears. The advancing and rotating piston engages a one-way clutch to rotate by advancing marking body through the same predetermined angle. This rotation changes the position of the indicator marker carried on the indicator body marking end. Thus, the marker arrangement is changed.

After the compressed air pulse ceases, the spring forces the marking body and the piston back to their normal positions. The gear means reverse the rotation upon the retreating piston so that it is in effect returned to its pre-pulse position and orientation. The marking body is secured in its rotated orientation by a detent assembly. The one-way clutch permits the returning piston to rotate back without rotating the marking body. The marking body returns to its marking position, wherein its marking end is coplanar with the housing marking end, but remains rotated compared to its pre-pulse position. After returning to its marking position, the apparatus is then employed to mark the next casting with the changed marker arrangement.

The marking apparatus of this invention requires only a minimum number of movable parts to effect a change in the marker arrangement and is constructed durable enough to withstand the pressures and jolting of the mold-forming operations. Since it is compressed air actuated, it may be easily located in the pattern and the marker-changing operations initiated from a point away from the pattern and outside the molding machine. Finally, it is small enough to be easily incorporated in a pattern. Therefore, the marking apparatus of this invention can be successfully employed in a commercial foundry to eliminate the necessity of periodic interruptions of production for changing the casting mark.

BRIEF DESCRIPTION OF THE DRAWINGS

The present invention will be further illustrated with reference to the accompanying drawings wherein.

DETAILED DESCRIPTION OF THE PREFERRED EMBODIMENT

Figure 1:
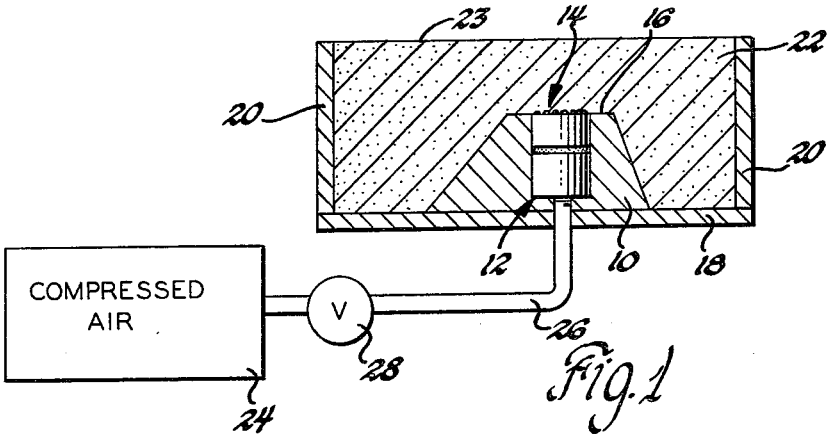
FIG. 1 is a cross-sectional view of a pattern in which the marking apparatus has been incorporated, illustrated during a mold-forming operation.

Referring now to FIG. 1, a foundry pattern 10 is illustrated having embedded in it the marking apparatus 12 of this invention. While a metallic pattern 10 is preferred, it could, of course, be constructed of any suitable material. The marking apparatus 12 is situated in the pattern 10 such that its marking surface 14 cooperates with the mold-forming surface 16 of the pattern 10 in forming the mold 22. In a preferred embodiment, the apparatus marking surface 14 is substantially coplanar with the pattern surface 16.

The pattern 10 and embedded apparatus 12 are then used according to standard mold-forming operations. The pattern is secured on stool 18. A flask 20 is positioned about pattern 10 on stool 18 and filled with an appropriate molding material 22 such as green sand, a mixture of lake sand, secal, clay and water. The mold is then formed by first repeatedly jolting the entire assembly and then applying a force of about 150 psi evenly across sand surface 23. An impression of the apparatus marking surface 14 is made in the mold 22 as it is formed. Afterwards the flask 20 and sand mold 22 are separated from pattern 10 and stool 18 and used for metal casting. Molten metal poured into the mold duplicates its shape. The marking surface 14 is thereby reproduced on the casting.

As described elsewhere herein, the apparatus 12 is actuated to change the marking surface 14. When desired, the change is accomplished by air pressure. The apparatus 12 is connected to a compressed air source 24 by a flexible air line 26 passing through stool 18 and pattern 10. Valve 28 located in air line 26 is operative to subject the apparatus 12 to an intermittent burst of compressed air. After the desired change has been accomplished, the valve 28 is then moved to a vent position to reduce the apparatus 12 to ambient air pressures. The valve 28 may be easily located remote from stool 18 and pattern 10 and outside the molding machine (not shown) so that apparatus 12 may be actuated without the operator entering the molding machine.

Figure 2:
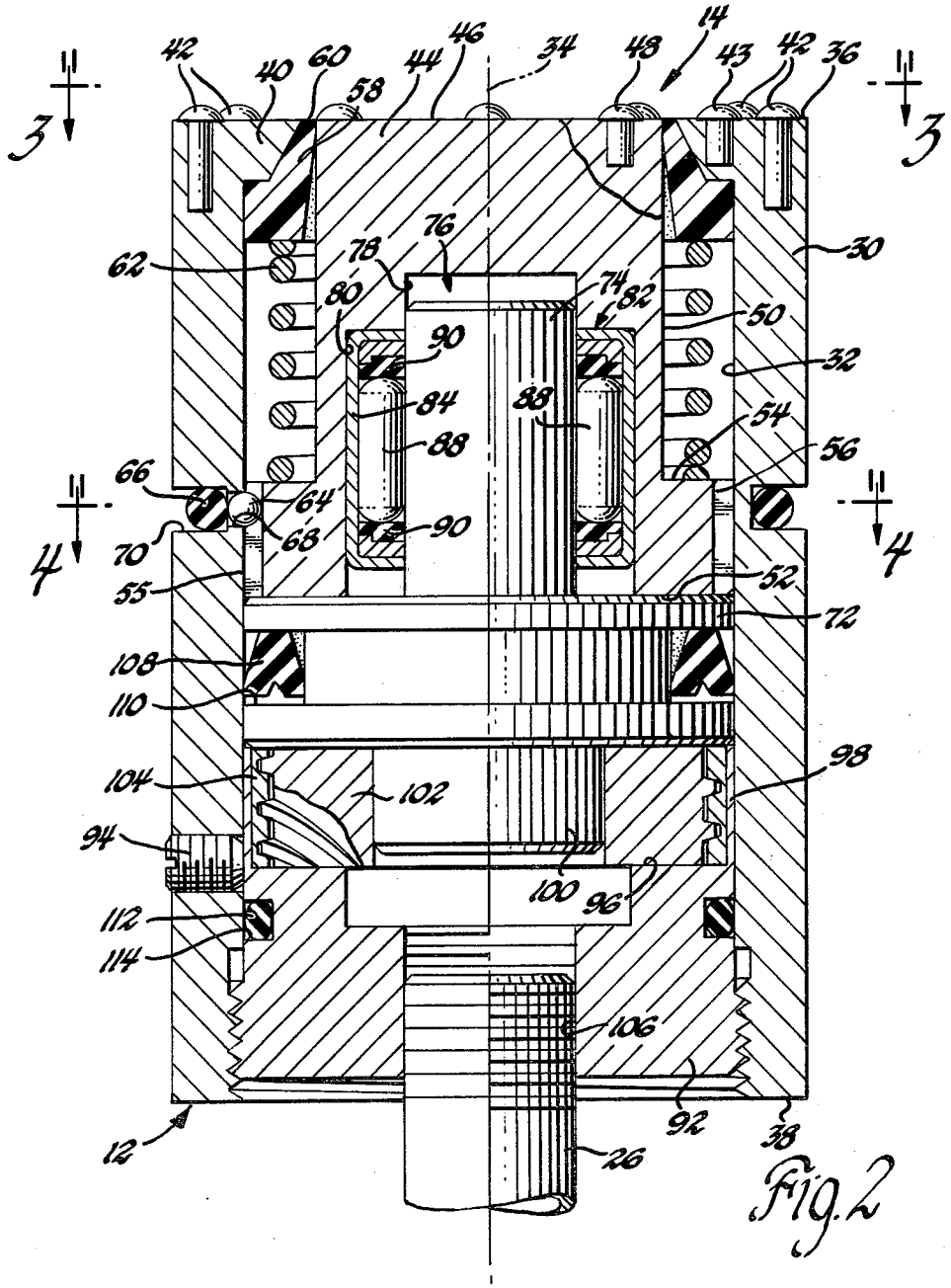
FIG. 2 is a cross-sectional view of a preferred embodiment of the marking apparatus of the present invention.

The marking apparatus 12 in its normal marking position is illustrated in more detail in FIG. 2. In this preferred embodiment, the apparatus 12 includes a cylindrical tube-like metallic housing 30. The housing inner wall 32 defines a circular cylindrical hollow having a cylindrical axis 34. The housing 30 has a marking end 36 perpendicular to axis 34 and adapted to act as part of the apparatus marking or mold-forming surface 14 when the apparatus 12 is incorporated in pattern 10. The housing second end 38 is embedded within pattern 10 remote from its mold-forming surface 16. A flange 40 protrudes inwardly from the housing inner wall 32 at the marking end 36.

Reference marker pins 42 and 43 are embedded in the housing marking end 36. The head of each pin 42 and 43 protrudes above the housing end 36 and is adapted to form an impression in the sand mold 22. The marking pins 42 are arranged at equal intervals about the circumference of a circle which is concentric with the axis 34, as can be better seen in FIG. 3. In this example, twelve reference markers 42 are positioned at 30° intervals similar to the hour marks of a clock face. Marker pin 43 designates the 12 o'clock position. Since marker pins 42 and 43 form reference marks on the casting, it is appropriate to say that the housing marking end 36 carries the reference markings.

Figure 3:
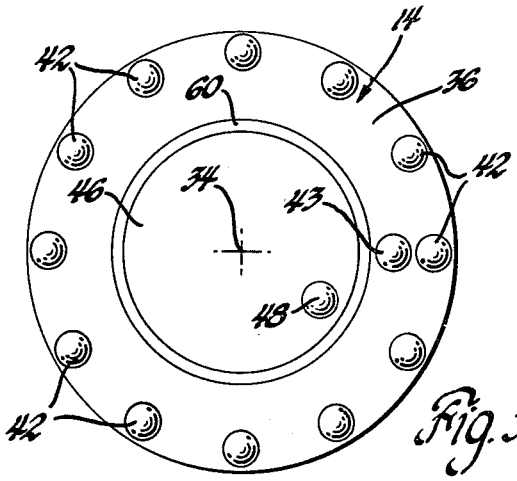
FIG. 3 is an end elevational view of the apparatus of FIG. 2 as taken along the plane of the line 3—3 and looking in the direction of the arrows.

Located within the housing 30 adjacent its marking end 36 and flange 40 is a generally cylindrical indicator marking body 44 having a cylindrical axis coincident with axis 34. The marking body 44 is slidably mounted so that it may be rotated about and reciprocated along axis 34. As illustrated in FIG. 2, the marking body 44 is in its rest or normal position wherein its marking end 46 is substantially coplanar with housing marking end 36. The marking body 44 lies in this position when employed in mold-forming operations. However, when apparatus 12 is actuated to change the casting mark, the marking body 44 moves along axis 34 to an advanced position in which the plane of marking surface 46 lies outside housing 30. Marking end 46 acts as part of the apparatus marking surface 14 and is perpendicular to axis 34. Embedded in it is a marker pin 48 similar to those employed as reference markers 42. Marker pin 48 is positioned off axis 34, as best seen in FIG. 3, to point to a reference marker 42 and thus serves as an indicator marker in a manner similar to a clock hour hand. Rotating the marking body 44 an angle of 30° about axis 34 causes the indicator marker 48 to point to a different reference marker. Thus, the position of the indicator marker 48 is the changeable feature of this embodiment of my marker apparatus.

The marking body has a smooth cylindrical surface 50 extending from its marking end 46 and widens abruptly at a point near its inner end 52 to form a shoulder 54 and a grooved cylindrical surface 55. Located about the smooth cylindrical surface 50 adjacent marking end 46 is an annular plastic seal 58 adapted from a commercially available rod wiper. Seal 58 fits snugly between body 44 and housing flange 40 to prevent loose sand and other foreign matter from entering apparatus 12, but not so tightly as to interfere significantly with the movement of the marking body 44. One seal end 60 is coplanar with housing and body marking ends 36 and 46 and constitutes part of the apparatus marking surface 14.

Encircling the marking body smooth surface 50 between seal 58 and shoulder 54 is a coil spring 62. The spring 62 maintains marking body 44 in its marking position during moldforming operations, but, when the device is actuated to change the indicator marker position, applies a counterforce to the air pressure and returns marking body 44 to its normal position after the pressure is discontinued.

Figure 4:
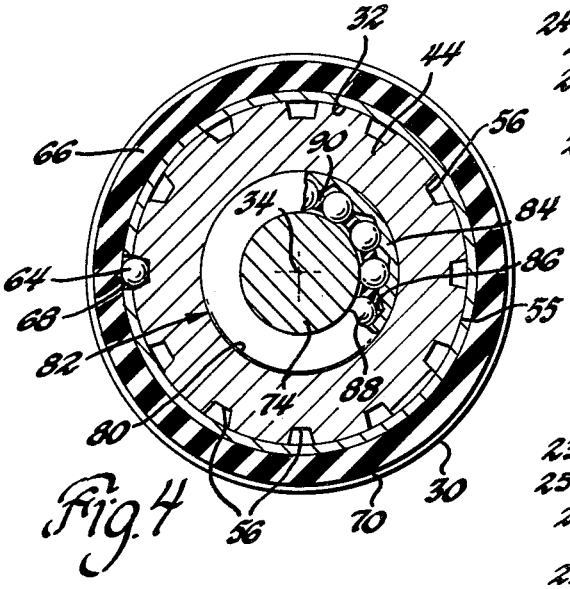
FIG. 4 is a cross-sectional view of the apparatus of FIG. 2 as taken along the plane of the line 4—4 and looking in the direction of the arrows.

Near the inner end 52, marking body 44 has a series of axial grooves 56 at equal intervals about its circumference, as seen with the aid of FIG. 4. At a minimum, the length of the grooved portion 56 must be as long as the distance of reciprocating motion of the marking body 44 and the number of grooves must equal the number of reference markers 42. Therefore, the location of the grooves corresponds to the angle through which indicator marker 48 is rotated when changing the casting mark, 30° in this example. Axial grooves 56 cooperate with steel ball bearing 64 and flexible plastic O-ring 66 to form a detent assembly, FIGS. 2 and 4. The steel ball 64 is positioned through a hole 68 in housing 30 and rests in a marking body groove 56. Steel ball 64 is secured in the groove 56 by O-ring 66 located in an annular groove 70 about housing 30. When in its marking position, the detent assembly is adapted to orient the marking body 44 so that indicator mark 48 points to a reference marker 42. When the position of the indicator marker 48 is changed, the rotating marking body 44 forces steel ball 64 out of one groove 56, stretching O-ring 66. Steel ball 64 is then secured in the next groove by O-ring 66 springing back into a circular configuration.

Slidably mounted within housing 30 adjacent the marking body inner end 52 is a circular cylindrical metallic piston 72 having an axis corresponding to axis 34 about which it may rotate and along which it may reciprocate. As illustrated in FIG. 2, piston 72 is in its rest or normal position. When apparatus 12 is actuated, the piston moves along axis 34 away from the end 38 to an advanced marking-changing position.

A first cylindrical piston rod 74, coaxial with axis 34, extends from the piston 72 into a two-diameter bore 76 in the marking body inner end 52. Rod 74 is slip fit into the smaller diameter portion 78 of the bore 76. Encircling the smooth rod 74 is a conventional one-way roller clutch 82. The roller clutch housing 84 is fixed to the shorter-depth, larger-diameter portion 80 of bore 76. Referring to FIGS. 2 and 4, clutch 82 comprises the usual ramp members 86 which cooperate with the conventional roller bearings 88 loosely held in a flexible plastic material 90 to operate in the usual fashion for one-way clutches. As illustrated, clutch 82 is engaged when the piston rotates clockwise to require a similar motion of the marking body 44, but permits independent counterclockwise rotation of the piston rod 74.

End cap 92 is screwed into the housing second end 38 and secured by set screw 94. End cap 92 has an annular shoulder 96 and extending from that shoulder (as seen in FIG. 2) is a relatively thin annular lip 98. Shoulder 96 and lip 98 define a cylindrical chamber whose cylindrical axis coincides with axis 34. Extending from the piston 72 into that chamber is a second cylindrical piston rod 100, whose axis also coincides with axis 34. Press fitted about the second piston rod is an externally-toothed helical gear 102 that rests on shoulder 96 when the apparatus 12 is in its marking position. An internally-toothed helical gear 104 is rigidly seated inside lip 98 against shoulder 96 and engages externally-toothed helical gear 102 in the usual manner.

The bore 106 through end cap 92 accepts a coupling for connecting apparatus 12 to air line 26 and thus allows compressed air to be admitted into the apparatus 12. A flexible plastic seal 108 located in an annular groove 110 about piston 72 and another flexible plastic seal 112 located in an annular groove 114 about end cap 92 prevent pressurized air from escaping from the apparatus 12.

Referring now to FIG. 3, the marking surface 14 of apparatus 12 is illustrated. Twelve reference markers 42 are embedded in the housing marking end 36 at equal intervals about the circumference of a circle concentric with axis 34 and represent hour marks. Reference marker 43 indicates the twelve o'clock position. The indicator marker 48 is embedded off-center in the indicator body marking surface 46 and, as illustrated, points to the one o'clock reference marker 42.

The position of the indicator marker 48 is changed by revolving it clockwise about axis 34 through an angle of 30° to align it with the two o'clock marker. This change is accomplished by subjecting the apparatus 12 to an intermittent compressed air, admitted to the apparatus 12 through end cap bore 106. The air pressure forces piston 72 (shown in its marking position in FIG. 2) to move along axis 34 in the direction of the apparatus marking surface 14 to an advanced, marking-changing position. The advancing piston 72 contacts the marking body inner end 52 and simultaneously moves the marking body 44 along axis 34 from its normal marking position (FIG. 2) to an advanced position, compressing coil spring 62 in the process. During the process air leakage is prevented by seals 108 and 112, which might otherwise dissipate the force of the compressed air.

The externally-toothed helical gear 102 cooperates with the internally-toothed helical gear 104 to rotate the advancing piston 72. The angle of rotation is determined by the length of piston advance and the gear pitch angles and, in this example, is 30°. Rotating piston rod 74 engages one-way clutch 82 to rotate marking body 44 through a similar angle of 30°. Thus, the indicator marker pin 48 revolves through an angle of 30° and the marking is changed.

The rotating marking body 44 forces detent ball 64 out of one groove 56, deforming the detent ring 66 in the process. After the marking body has rotated, ball 64 is secured in the next counterclockwise groove 56 by the detent ring 66 returning to its circular state.

When the air pressure is discontinued, the compressed spring 62 forces marking body 44 to return along axis 34 to its marking position (FIG. 2). The returning marking body 44 contacts piston 72 to simultaneously return it to its normal position. As piston 72 retreats, the helical gears 102 and 104 reverse the rotation the piston experienced as it initially advanced. Thus, the position of piston 72 after the marking-changing operation is in all respects identical to its pre-pulse position. However, one-way clutch 82 allows piston 72 to reverse its rotation independently and the marking body 44 is secured in its rotated orientation by the detent ball 64 and spring 66. Thus, after the compressed air pulse, the marking body 44 is in the same axial position as it was in before the pulse, but is rotated by an angle of 30°.

Another pulse of compressed air repeats the process and rotates the marking body 44 and revolves the indicator marker pin 48 through another angle of 30°.

Figure 5:
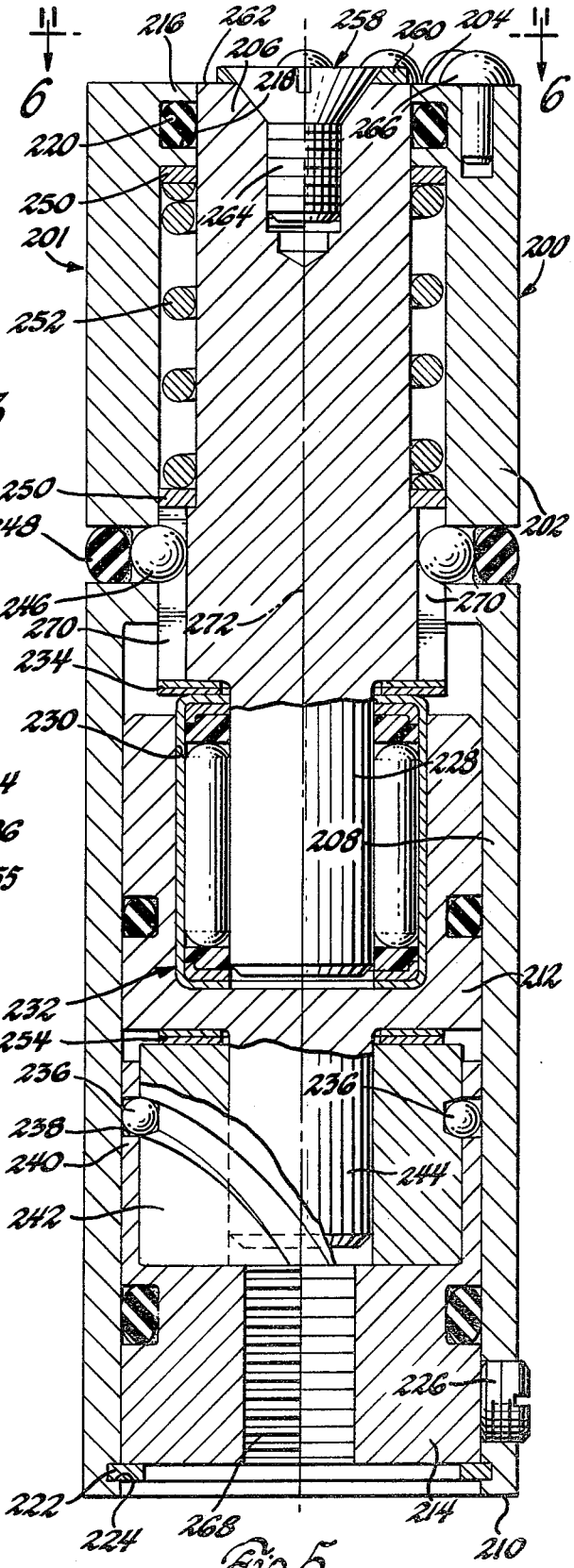
FIG. 5 is a cross-sectional view of an alternative preferred embodiment of the marking apparatus of this invention.

FIG. 5 illustrates an alternative embodiment of the marking apparatus 201 of this invention.

The housing 200 comprises a smaller-inner diameter cylindrical portion 202 near the housing marking end 204 and encircling the marking body 206 and a larger-inner-diameter portion 208 extending to the second housing end 210 and encircling the piston 212 and end cap 214. A flange 216 extends inwardly from the housing and closely engages the marking body 206. An annular groove 218 in the flange 216 adjacent the marking body 206 is formed for receiving a circular flexible plastic O-ring 220 and thereby forming a seal between housing 200 and marking body 206 to prevent loose sand and other foreign matter from entering the apparatus 201.

End cap 214 is slip fit within the larger diameter portion of the housing and retained by metallic ring 222 set in an annular groove 224. Set screw 226 extending through the housing 200 secures the end cap 214 and prevents it from rotating.

One major difference in this alternative embodiment concerns the manner in which the piston 212 contacts the marking body 206. In lieu of a piston rod 74 as depicted in FIG. 2, a male cylindrical member 228 extends coaxially from marking body 206 into a single diameter cylindrical opening 230 in the piston 212. Cylindrical member 228 is received in one-way roller clutch 232 (exactly like clutch 82 in FIG. 2) which in turn is press fitted to piston opening 230. In this embodiment the roller clutch 232 operates as described above and is engaged by a clockwise rotating piston 212 to rotate the marking body 206 clockwise, but enables piston 212 to rotate counterclockwise freely without rotating the marking body member 228. Piston 212 does not physically contact marking body 206 but communicates its advancing motion to the body via roller clutch 232 and shims 234.

Another significant difference in this alternative embodiment is that the internally-toothed helical gear 104 (FIG. 2) has been eliminated and replaced with steel balls 236 positioned in transverse holes 238 in the end cap annular lip 240. These steel balls 236 extend partway into the grooves in the externally-toothed helical gear 242 press fitted about cylindrical piston rod 244 coaxially extending toward second housing end 210. The balls 236 cooperate with helical gear 242 to rotate piston 212 as it moves along axis 272.

One skilled in the art would readily perceive that roller clutches and helical gears are readily commercially available. However, only certain sizes are generally marketed. A significance of changing the position of roller clutch 82 and eliminating internally-toothed helical gear 104 is that the same size units in the embodiment of FIG. 2 can be employed in this embodiment to produce an apparatus having a smaller overall diameter. Other minor differences include employing two detent balls 246 biased by an O-ring 248 to better secure marking body 206. Washers 250 located about the coil spring 252 and the shims 254 located about the piston rod 244 adjust the fit of the apparatus components.

Figure 6:
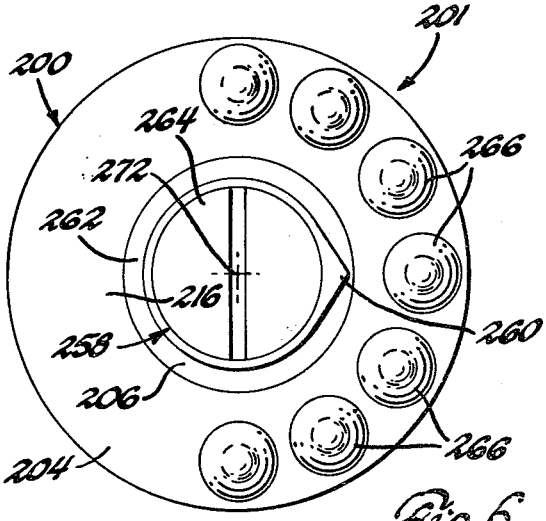
FIG. 6 is an end elevational view of the apparatus of FIG. 5 as taken along the plane of the line 6—6 and looking in the direction of the arrows.

Another major difference in this alternative embodiment concerns the nature of the indicator marker 258, as can be better seen in FIG. 6. In lieu of revolving pin 48 (FIG. 3) the indicator marker 258 in this assembly 201 comprises a pointer 260 attached to marking body marking end 262 by screw 264. Seven reference markers 266 (similar to markers 42 in FIG. 2) are semicircularly arranged to convey the day of the week during which the casting was made. When the apparatus is actuated by air pressure, marking body 206 rotates 30° and this is normally sufficient to align it with a different reference marker 266. However, once a week apparatus 201 must be actuated six consecutive times in order to point indicator marker 258 to the next reference marker 266.

The orientation of the indicator marker 258 is changed in a similar fashion to that of the first embodiment (FIG. 2). The compressed air pulse enters through a hole 268 in end cap 214 and forces piston 212 to advance along axis 272. The advancing piston 212 is rotated clockwise by steel balls 236 cooperating with the grooves of the helical gear 242. The advancing and rotating piston 212 advances marking body 206 along axis 272 and concurrently engages one-way clutch 232 to rotate the marking body 206 clockwise. The rotating and advancing marking body 206 forces each detent ball 246 out of one marking body groove 270, deforming detent O-ring 248 in the process. After marking body 206 has rotated, each detent ball 246 is secured by O-ring 248 in the groove counterclockwise its initial groove. The rotation of the marking body 206 rotates the indicator marker 258 clockwise to point it to a different reference marker 266. As it is advancing, the marking body 206 compresses coil spring 252 and, after the air pressure is discontinued, coil spring 252 returns marking body 206 along axis 272 to its normal position illustrated in FIG. 5. Simultaneously, piston 212 is returned to its normal position. Steel balls 236 and helical gear 242 rotate the returning piston 212 counterclockwise so that, after the marking-changing operation, piston 212 is situated the same as before. However, steel balls 246 and ring 248 act as a detent assembly and cooperate with one-way clutch 232 to secure marking body 206 in its rotated orientation, uneffected by the reverse piston rotation.

Although in these preferred embodiments the housing, piston, marking body and end cap were constructed of metal, they could, of course, be constructed of any suitable material. It is also apparent that other type of seals, spring means, clutch means, detent assembly and rotating gears might be employed in the practice of the present invention. Any suitable pneumatic or hydraulic pulse could be adapted to actuate the apparatus. While a hand-operated valve is economically preferred, an automatic triggering device might easily be incorporated in the pressurized fluid line.

It is also apparent that the outer shape of the housing can be varied to enable it to be easily incorporated in a particular pattern. In an appropriate case, the housing might be the pattern itself. it is also apparent that the reference markers could be embedded in the pattern instead of the housing or, in an appropriate case, eliminated entirely.

One skilled in the art would readily perceive that a wide variety of information could be conveniently displayed with the marking apparatus of this invention. Although in the preferred embodiment the orientation of the indicator marker was changed 30° each time the apparatus was actuated, the angle of displacement can be easily adjusted by varying the length of the piston advance and selecting suitable gears. Thus, virtually any number of indicator marker positions is possible.

While this invention has been disclosed primarily in terms of certain embodiments thereof, it is not intended that it be limited thereto but rather only to the extent set forth in the claims that follow.

I claim:

1. A marking machine bearing a marker whose position may be altered to change the marking produced by the machine, said machine comprising a marking body having an axis about which it may rotate and along which it may reciprocate, said body having a marking end perpendicular to its axis and carrying a marker, a piston having an axis concentric with the marking body axis, said piston being movable in response to fluid pressure along its axis in the direction of the marking body to cause said marking body to simultaneously move along its axis, gear means operatively connected to the piston for rotating the piston through a predetermined angle as it moves along its axis, clutch means intermediate said marking body and said piston and adapted to permit the rotating piston to rotate the marking body in only one direction to alter the marker position, but otherwise permitting independent piston rotation, resilient means engaged by the marking body moving in response to said fluid pressure actuated piston, said resilient means thereby becoming operative to move the piston and marking body back along their axis, and detent means engaging said marking body and adapted to act in conjunction with said clutch means to permit the marking body to undergo said rotation, but otherwise securing the marking body from rotation, said machine being employable to mark when the marking body and piston are stationary but selectively actuatable between marking operations to alter the marking by altering the marker position.

2. An apparatus adapted to be incorporated in a foundry pattern of the type employed to sequentially form a series of foundry molds for metal castings, said apparatus being adapted to form a marking in said molds and comprising a housing defining a generally cylindrical hollow having a cylindrical axis, a generally cylindrical marking body coaxially mounted in said hollow, said body having a mold-forming end bearing a marker and lying substantially perpendicular to said axis, said marking body being rotatable about said axis to alter the position of said marker and movable along said axis between a normal position for mold-forming and marking and a marking-changing position, a generally cylindrical piston coaxially mounted within said hollow and rotatable about said axis, said piston being responsive to intermittent fluid pressure to move along said axis from a normal position to a marking-changing position and to cause said marking body to move from its normal position to its marking-changing position, resilient means within the hollow and adapted to be acted upon by said piston and marking body when moving in response to fluid pressure, and to return said marking body and piston along said axis to their respective normal positions after fluid pressure is discontinued, gear means engaging the piston and adapted to rotate said piston a predetermined angle about said axis as said piston moves along said axis, clutch means intermediate said piston and said marking body and adapted to permit the piston rotating in one direction to engage and rotate said marking body to thereby alter said marker position, said clutch means permitting independent piston rotation in the opposite direction and detent means carried by said housing and adapted to secure said marking body from rotation when in its normal position but permit said body to rotate when said clutch is engaged.

3. A marking apparatus adapted to be incorporated in a foundry pattern of the type employed to produce a series of sand molds for metal castings and further adapted to shape a portion of each sand mold to produce a marking on a casting made therein, said marking being adapted to convey certain information by its position, said apparatus comprising a housing defining a generally cylindrical hollow having a cylindrical axis and an opening for admitting intermittent fluid pressure, a cylindrical marking body coaxially mounted in the housing hollow, said body having a mold-forming end bearing a marker and lying substantially perpendicular to said axis, said marking body being rotatable about said axis to alter the position of said marker, said body being movable along said axis between a normal position for mold-forming and marking and a marking-changing position, a generally cylindrical piston slidably mounted within said hollow coaxial therewith and situated between the marking body and housing opening, said piston being responsive to fluid pressure to advance from a normal position along said axis to a marking-changing position and to cause the marking body to advance from its normal position to its marking-changing position, gear means operatively connected to the piston and adapted to rotate the piston about said axis when said piston moves between its normal position and its marking-changing position, one-way clutch means engaged by the piston and adapted to rotate the marking body only when it advances to thereby alter the marker position, resilient means supported by said housing and adapted to be acted upon by the advancing piston and marking body and to thereafter return the marking body and piston to their respective normal positions, and detent means carried by said housing and adapted for securing the marking body from rotation when in its normal position and cooperating with said clutch means to permit the advancing marking body to rotate.

4. In a foundry pattern of the type employed to sequentially form a plurality of foundry molds for making metal castings, an apparatus comprising a housing defining a generally cylindrical hollow having a cylindrical axis and an opening for admitting intermittent fluid pressure, a generally cylindrical marking body coaxially mounted within said hollow, said body having a marking end lying substantially perpendicular to said axis and carrying a marker, said marking end and marker being adapted to act in conjunction with said pattern to form a marking in said molds, said body being rotatable about said axis to alter the position of said marker and thereby change the marking formed in subsequent molds, said body being movable along said axis between a normal position in which said body lies during mold forming and a marking-changing position, a generally cylindrical piston coaxially mounted within said hollow between said body and said housing opening, said piston being responsive to fluid pressure to move along said axis from a normal position towards said body to a marking-changing position and causing said body to move from its normal position to its marking-changing position, resilient means within said hollow adapted to be acted upon by said marking body and piston moving in response to fluid pressure and to move said body and said piston along said axis from their respective marking-changing positions to their respective normal positions after the fluid pressure is discontinued, gear means operative between the housing and the piston and adapted to rotate said piston about said axis as it moves along said axis, clutch means intermediate the piston and the marking body adapted to be engaged by the piston as it moves along said axis from its normal position to its marking-changing position so as to rotate the marking body and thereby alter the marker position, but permitting the piston to rotate without affecting the marking body when said piston moves from its marking-changing position to its normal position, and detent means carried by said housing for securing said marking body from rotation when in its normal position and cooperating with said clutch means to permit said marking body to rotate as it moves from its normal position to its marking-changing position.

5. In a foundry pattern of the type employed to sequentially form a plurality of foundry molds for making metal castings, an apparatus adapted to act in conjunction with said pattern to form in said foundry molds a marking comprising a reference marking and an indicator marking, said apparatus comprising a housing defining a generally cylindrical hollow having a cylindrical axis, said housing having a first and second end, said first end lying substantially perpendicular to said axis and carrying at least one stationary marker and adapted to form said reference marking, a generally cylindrical marking body coaxially mounted within said hollow adjacent said housing first end and having a marking end substantially perpendicular to said axis and carrying a marker for forming said indicator marking, said body being rotatable about its axis to alter the position of said indicator marker and thereby change the marking formed in subsequent molds, said body being movable along its axis between a normal position in which said marking end lies substantially coplanar with said housing first end and a marking-changing position in which the plane of the body marking end lies outside the housing, said body lying in said normal position during marking operations, said body also having a cylindrical surface comprising axial grooves evenly spaced about said body, an end cap located adjacent the second housing end and comprising an opening for admitting intermittent fluid pressure into the apparatus, a generally cylindrical piston coaxially mounted within the hollow between the marking body and the end cap, said piston being rotatable about said axis and capable of moving along said axis, said piston being responsive to fluid pressure to advance from a normal position away from said end cap to a marking-changing position and simultaneously causing said marking body to advance from its normal position to its marking-changing position, spring means intermediate the housing and the marking body and adapted to be acted upon by said advancing marking body and piston and to thereafter move said body and piston from their respective marking-changing positions to their respective normal positions when the fluid pressure is discontinued, helical gear means operatively connected to the piston and adapted to rotate the piston about said axis through a predetermind angle as said piston moves along said axis, one-way clutch means intermediate the piston and the marking body and adapted to be engaged by an advancing and rotating piston to rotate said marking body and thereby alter said indicator marker position, but to permit the returning piston to rotate without affecting said marking body, and detent means comprising at least one detent ball and an elastic ring carried by the housing, said ring normally securing said ball partially in a marking body axial groove said thereby securing the marking body from rotation, but said ring being sufficiently elastic to permit said ball to be forced out of one groove and into another by said advancing and rotating marking body.

* * * * *

UNITED STATES PATENT AND TRADEMARK OFFICE

CERTIFICATE OF CORRECTION

PATENT NO. : 4,137,962

DATED : February 6, 1979

INVENTOR(S) : Kenneth J. Pol

It is certified that error appears in the above-identified patent and that said Letters Patent are hereby corrected as shown below:

Column 14, line 10, "said" should read -- and --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*